US008322053B2

(12) United States Patent
Handel et al.

(10) Patent No.: US 8,322,053 B2
(45) Date of Patent: Dec. 4, 2012

(54) ADJUSTABLE HEIGHT HIGH HEEL SHOE

(75) Inventors: David Handel, Galloway, NJ (US); Ian White, Kennett Square, PA (US); David White, Kennett Square, PA (US)

(73) Assignee: Sean Flannery, Mountainside, NJ (US)

( * ) Notice: Subject to any disclaimer, the term of this patent is extended or adjusted under 35 U.S.C. 154(b) by 928 days.

(21) Appl. No.: 11/667,574

(22) PCT Filed: Apr. 14, 2006

(86) PCT No.: PCT/US2006/014322

§ 371 (c)(1),
(2), (4) Date: Nov. 9, 2007

(87) PCT Pub. No.: WO2006/113574

PCT Pub. Date: Oct. 26, 2006

(65) Prior Publication Data

US 2008/0184598 A1 Aug. 7, 2008

Related U.S. Application Data

(60) Provisional application No. 60/672,475, filed on Apr. 18, 2005.

(51) Int. Cl.

| | |
|---|---|
| ***A43B 21/00*** | (2006.01) |
| ***A43B 3/24*** | (2006.01) |
| ***A43B 3/00*** | (2006.01) |
| ***A43B 21/433*** | (2006.01) |

(52) U.S. Cl. ..... 36/100; 36/36 R; 36/42

(58) Field of Classification Search ..... 36/100, 36/101, 42, 36 R, 36 B, 36 C See application file for complete search history.

(56) References Cited

U.S. PATENT DOCUMENTS

| | | | | |
|---|---|---|---|---|
| 2,258,265 | A | 10/1941 | Schwartz | |
| 2,767,489 | A * | 10/1956 | Sturman | 36/34 R |
| RE25,984 | E * | 3/1966 | Ronci | 36/42 |
| 3,464,126 | A | 9/1969 | Sarkissian | |
| 4,085,320 | A * | 4/1978 | Wilwerding | 250/201.8 |
| 4,416,072 | A | 11/1983 | Sarkissian | |
| 5,058,290 | A * | 10/1991 | Koehl et al. | 36/42 |
| 5,309,651 | A | 5/1994 | Handel | |
| 5,339,543 | A * | 8/1994 | Lin | 36/101 |
| 5,538,367 | A * | 7/1996 | Ashley et al. | 407/3 |
| 5,887,360 | A * | 3/1999 | Bucalo et al. | 36/100 |
| 7,059,068 | B2 * | 6/2006 | Magallanes et al. | 36/100 |
| 2001/0052195 | A1 * | 12/2001 | Blakey | 36/100 |
| 2007/0289167 | A1 * | 12/2007 | Pieriboni | 36/100 |

* cited by examiner

*Primary Examiner* — Jila M Mohandesi
(74) *Attorney, Agent, or Firm* — Norman E. Lehrer

(57) ABSTRACT

A shoe has a sole with a toe, heel and arch. A two part heel has a low heel block attached to the sole heel and includes a slot therein. A high heel extension is attached to the low heel block through a support beam having a substantially rectangular cross-section capable of limited axial and pivotal movement. The fit between the beam and the slot prevents rotational movement of the high heel about its axis. The high heel extension can be pivoted between a first position where it underlies the low heel block and a second position where it lies beneath the sole arch. The bottom of the low heel block has a heel lift extending downwardly engaging the ground when the high heel is stowed. This low heel lift is enclosed by a beveled edge at the top of the high heel piece when it is vertical.

20 Claims, 5 Drawing Sheets

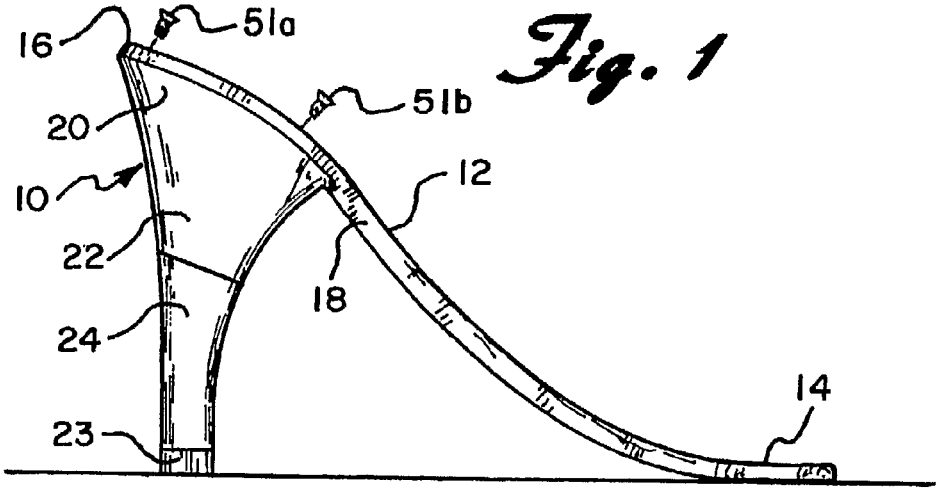
Fig. 1
Fig. 3
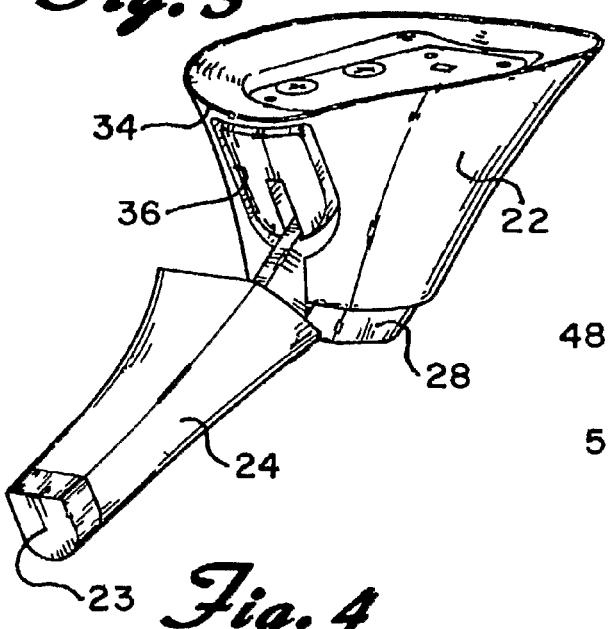
Fig. 2
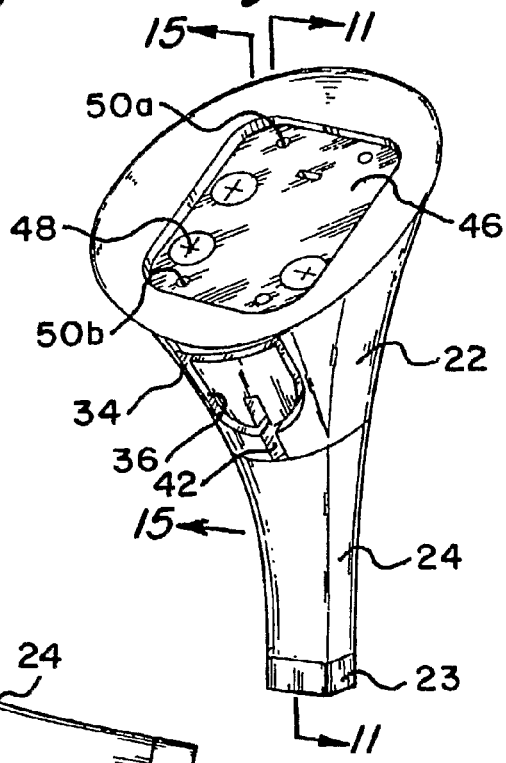
Fig. 4
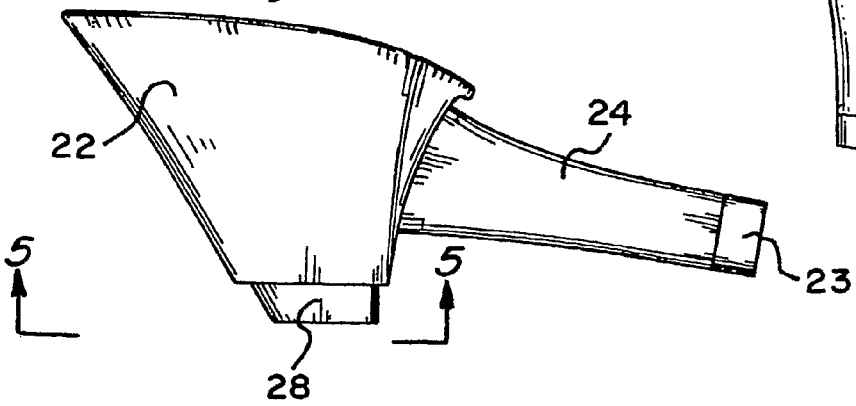

ADJUSTABLE HEIGHT HIGH HEEL SHOE

CROSS-REFERENCE TO RELATED APPLICATIONS

This application claims the benefit of U.S. Provisional Patent Application Ser. No. 60/672,475, filed Apr. 18, 2005.

TECHNICAL FIELD

The present invention is directed toward an adjustable heel for high heel shoes and more particularly, toward a shoe heel that may be adjusted from a low heel to a high heel and vice versa.

BACKGROUND ART

Women often wear shoes with different heel heights. For example, when commuting, a woman may prefer to wear a low heeled shoes, flat shoes or sneakers. Wearing such shoes is more comfortable than wearing high heeled shoes when having to walk or drive a distance. Then, upon arriving at her place of business, she may prefer to wear a shoe with a higher heel. This may pose a problem or, at the very least, an inconvenience as the woman would have to carry an extra pair of shoes to work and then change once she has arrived. Alternatively, she may have to leave several pairs of shoes at the workplace. This creates a further problem if the woman finds that she needs a pair of shoes that have been left at the workplace, such as during the weekend.

In another situation, a woman may find that she needs shoes with differing heel heights when traveling. This creates a problem when packing a suitcase in that many pairs of shoes need to be stored within a confined space. Shoes are rather bulky and awkward to pack and often take up a lot of space within a bag.

Also, extended use of high heeled shoes may cause foot ailments. The present invention serves to decrease the incidence of those ailments by offering women the opportunity to reduce the total time that they wear shoes that have high heels.

Solutions to the situations discussed above have been proposed. See, for example, U.S. Pat. No. 2,258,265 to Schwartz and U.S. Pat. Nos. 3,464,126 and 4,416,072 to Sarkissian. The Schwartz solution is unacceptable as it requires a women to carry multiple heels with her and to attach the one that is desired each time she wishes to change the height of her heel. Sarkissian, on the other hand does not actually change the height of the heel but simply moves the inner sole of the shoe up or down relative to the fixed heel. This results in a rather complex arrangement.

Prior U.S. Pat. No. 5,309,651 to Handel (one of the present Applicants) was an improvement on the several patents discussed above in that it provided for a two part heel wherein the lower heel part could be moved between an upright position to form a high heeled shoe to a stowed position to form a low heel shoe. In the stowed position, the lower heel part is positioned out of the way beneath the arch portion of the shoe.

It was subsequently found, however, that the mechanism that permitted such movement is not sufficiently stable or strong enough to prevent disengagement of the two heel parts with resultant collapse of the heel. This design flaw in that invention is due to a couple of factors. First, when in the high heel position, the wearer's weight is born almost entirely by the impaction of the high and low heel parts against each other and against the intervening low heel lift. As that lift wears away from use, the weight bearing interface between the parts becomes diminished. Furthermore, the high and low heel parts when in the high heel position are guided and biased together by a spring biased pin or post. This spring/pin combination is inherently unstable because the pin, surrounded by a spring, can not be fitted within a channel with a tight enough tolerance to prevent wiggle and movement since an allowance must be made for the fact that the spring diameter changes between the states when it being compressed or distracted. The result is that the mechanism is unstable and can easily allow the heel parts to wiggle and topple. This is particularly true as the low heel lift mentioned above wears away.

Therefore, a need exists for a shoe with an adjustable heel height that is easy and convenient for a woman to utilize but which is strong and stable enough to provide adequate support for the wearer.

DISCLOSURE OF THE INVENTION

The present invention is designed to overcome the deficiencies of the prior art discussed above. It is an object of the present invention to provide an adjustable heel for a woman's shoe.

It is another object of the present invention to provide a shoe with an adjustable heel that is easy and convenient for a woman to use.

It is further object of the present invention to provide a shoe with an adjustable heel that can be changed between the low and high heel states, quickly, without the need for tools and without the need to remove any of the shoe's parts.

It is a further object of the present invention to provide a shoe with an adjustable heel that is also aesthetically pleasing.

It is an even further object of the present invention to provide a shoe with an adjustable heel that is strong, secure and stable enough to prevent injury to the woman wearing the same.

In accordance with the illustrative embodiments demonstrating features and advantages of the present invention, there is provided a shoe having a sole with a toe portion, a heel portion and an arch portion located between them. A two part heel has a low heel block attached to the heel portion of the sole and includes a slot formed therein. A high heel extension piece is attached to the low heel block through a support beam having a substantially rectangular cross-section. The support beam is capable of limited axial and pivotal movement within slot. The dimensions of the support beam and the slot prevent rotational movement of the high heel extension piece about its central axis. The high heel extension piece can be pivoted relative to the sole between a first position wherein it underlies and is in alignment with the low heel block in a high heel configuration and a second position wherein it lies stowed beneath the arch portion of said sole and substantially parallel to the ground in a low heel configuration. The bottom of the low heel block has a low heel lift that extends downwardly and engages the ground when the high heel extension piece is stowed. This low heel lift is covered and completely hidden by a beveled edge at the top of the high heel extension piece when the heel mechanism is in its high heel configuration. A detent mechanism in the form of a spring biased ball incorporated within a rotatable pivot contained inside the low heel block and a depression in the support beam maintain the high heel extension piece in the desired position.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently shown; it being understood that the invention is not intended to be limited to the precise arrangements and instrumentalities shown.

FIG. 1 is a side elevational view of a heel constructed in according with the principles of the invention and shown in its first or high heel configuration;

FIG. 2 is a top front perspective view thereof;

FIG. 3 is a view similar to FIG. 2 but showing the high heel extension piece in the process of being stowed into the low heel configuration;

FIG. 4 is a side elevational view showing the heel in the second fully lowered position, the low heel configuration;

BEST MODE FOR CARRYING OUT THE INVENTION

Figure 5:
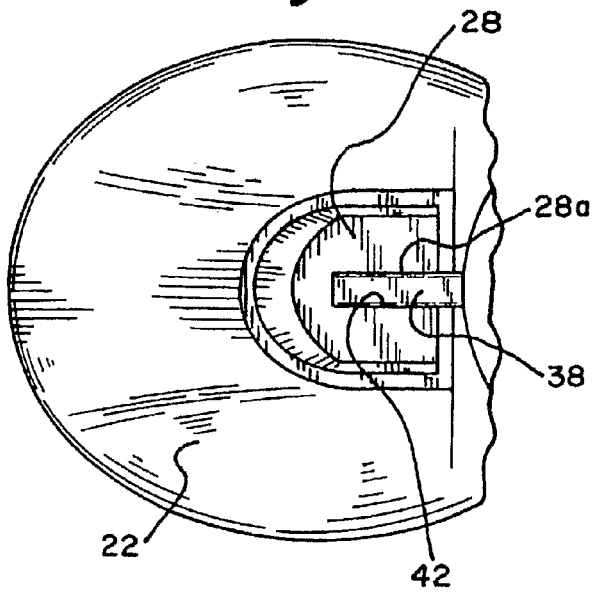
FIG. 5 is a plan view of the bottom of the low heel block and low heel lift taken through the line 5-5 of FIG. 4.

Referring now to the drawings in detail wherein like reference numerals have been used throughout the various figures to designate like elements, there is shown in FIG. 1 an adjustable high heel shoe constructed in accordance with the principles of the present invention and designated generally as 10.

The adjustable shoe 10 of the present invention essentially includes a sole 12 with a toe portion 14, a heel portion 16 and an arch portion 18 located between the heel and toe portions. A stowable heel 20 is secured to the heel portion 16 of the sole 12. The heel may be secured to the sole by various methods known by those skilled in the arts including by screws as shown in the preferred embodiment. The sole 12 may take many forms as will be apparent to those skilled in the art. The essence of the present invention lies in the stowable heel 20.

The stowable heel 20 includes a low heel block 22 and a high heel extension piece 24 which is attached to the low heel block 22 utilizing a mechanism to be described in more detail hereinafter. The high heel extension piece 24 can be pivoted relative to the sole 12 between a first position as shown in FIGS. 1 and 2 where it underlies and is in substantial alignment with the low heel block 22, the high heel configuration, and a second position as shown in FIG. 4 where it lies substantially parallel to the ground beneath the arch portion 18 of the sole 12, the low heel configuration.

When the high heel extension piece 24 is in the first position as shown in FIGS. 1 and 2, a high heel shoe is created. In order to prevent excessive wear to the lowermost part of the high heel extension piece 24, a replaceable high heel lift 23 made of a wear-resistant material is secured thereto.

Figure 11:
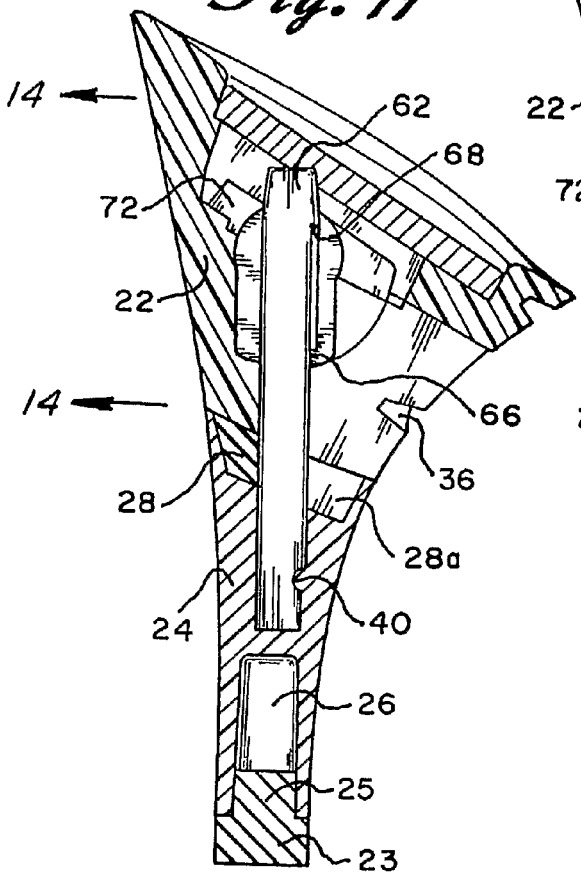
FIG. 11 is a cross-sectional view taken through the line 11-11 of FIG. 2.
Figure 12:
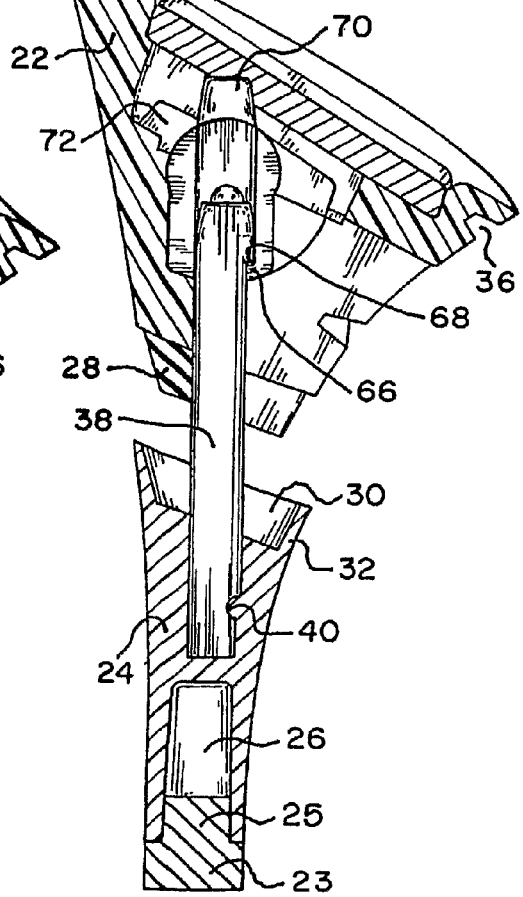
FIG. 12 is a cross-sectional view similar to FIG. 11 but with the high heel extension piece extended in preparation for pivotal movement into its lower position.

In the preferred embodiment, for the purposes of securing the high heel lift 23 to the high heel extension piece 24, the high heel lift 23 has a upwards projection or stem 25 as seen in FIGS. 11 and 12 that plugs into a corresponding aperture 26 in the lowermost part of the high heel extension piece 24. Stem 25 and aperture 26 have non-circular cross sections so that stem 25 can not twist and rotate within aperture 26. It is anticipated, in the preferred embodiment, that stem 25, or the inner walls of aperture 26, or both, may have textural features on its surfaces such as ribs, bumps, grooves or other contours which will allow the stem to be forced into aperture 26 and more securely grip the inner walls of the aperture for the purpose of contributing to affixing stem 25 to the high heel extension piece 24. The high heel lift 23, however, in the preferred embodiment, when sufficiently worn, can be deliberately removed and replaced.

In the alternative to the preferred embodiment, the high heel lift 23 can be secured to the high heel extension piece 24 by any known means.

Figure 6:
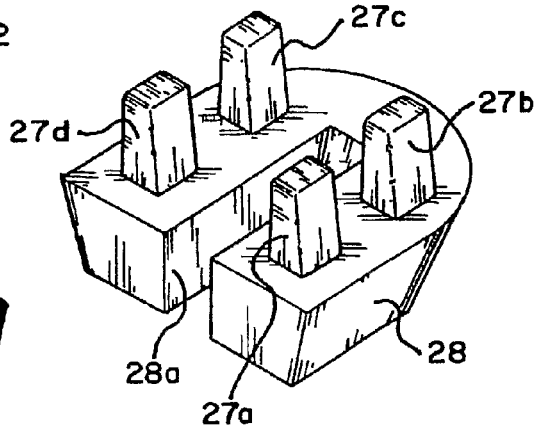
FIG. 6 is a top perspective view of the heel lift of the low heel block.
Figure 7:
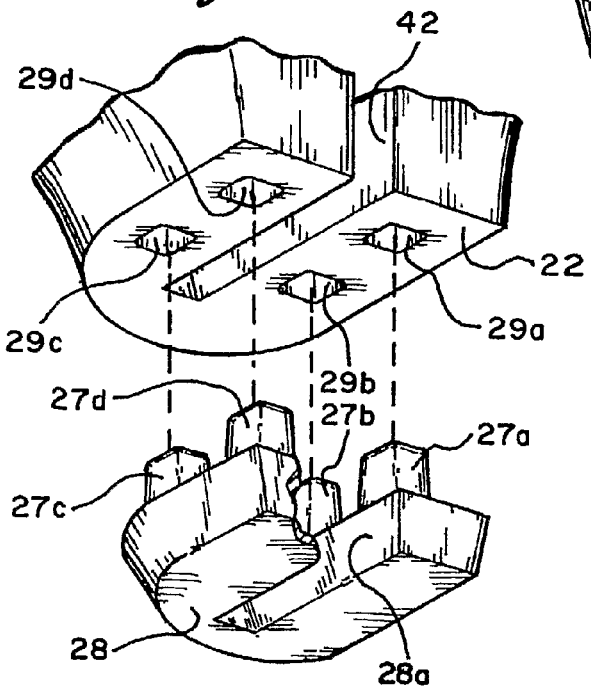
FIG. 7 is a bottom perspective view of the heel lift of the low heel block showing the manner in which it is attached to the low heel block.

As shown most clearly in FIGS. 3 and 4, the bottom of the low heel block 22 has attached to it its own heel lift 28 that has a unique horse shoe or U-shape shape. This low heel lift 28 engages the ground when the high heel extension piece 24 is moved into the second position as shown in FIG. 4 so as to create a low heel shoe. The low heel lift 28 also is preferably made of a wear-resistant material. Because the low heel lift 28 is subject to wear, it also is replaceable. As shown in FIGS. 6 and 7, the upper surface of the low heel lift includes four upwardly extending stems 27*a*, 27*b*, 27*c* and 27*d*. The stems are preferably molded of the same material from which the remaining part of the low heel lift is made and are molded as a single unit. The stems 27*a*, 27*b*, 27*c* and 27*d* frictionally fit into their corresponding apertures 29*a*, 29*b*, 29*c* and 29*d* formed into the lower surface of the low heel block 22 (FIG. 7), in a manner analogous to that just described above for stem 25 and aperture 26.

In the preferred embodiment of the invention, the low heel lift 28 of the low heel block 22 is essentially U-shaped, having a slot 28*a* cut through its shape as seen in FIGS. 5 and 6. The side walls of slot 28*a* are co-planar with the side walls of slot 42 of low heel block 22. A recess 30, best shown in FIG. 12, is formed in the top of the high heel extension piece 24 that corresponds to the shape of low heel lift 28. The recess 30 is surrounded by a beveled edge 32. The beveled edge 32 completely surrounds the recess 30. This beveled edge 32 completely encloses and hides the low heel lift 28 when the invention is in the high heel position as in FIG. 11.

As shown most clearly in FIGS. 11 and 12 and as will be explained in more detail hereinafter, the high heel extension piece 24 is axially movable up and down relative to the low heel block 22. When the high heel extension piece 24 is moved upwardly as shown in FIG. 11, the low heel lift 28 at the lower end of the low heel block 22 fits neatly into the recess 30 at the top of the high heel extension piece 24 as these two shapes are essentially complementary to each other. The beveled edge 32 that surrounds the recess 30 then fits around the outer periphery of the low heel lift 28. The outer surface of the beveled edge 32 is shaped so as to be complementary to the outer surface of the low heel block 22 so that a smooth transition is formed between the low heel block 22 and high heel extension piece 24 as shown most clearly in FIGS. 1 and 2. The beveled edge 32 acts to completely hide the low heel lift 28 when the heel is in the high heel configuration as seen in FIGS. 1 and 2. If the low heel lift 28 was not hidden in this manner it would be unsightly.

The forward surface 34 of low heel block 22 facing towards the toe region of the foot and includes an opening 36 which is essentially the same shape as the perimeter of the beveled edge 32. When the high heel extension piece 24 is moved into the second position as shown in FIG. 4, a substantial portion beveled edge 32 of the high heel extension piece 22 fits into the opening 36.

As pointed out above, the high heel extension piece 24 is connected to the low heel block 22 so as to allow for limited axial movement. The high heel extension piece 24 can also be pivotally moved relative to the low heel block 22 and the sole 12. Thus, when it is desired to move the high heel extension piece 24 from the high heel position as shown in FIG. 11 to the low heel position (FIG. 13), the high heel extension piece 24 is first pulled downwardly as shown in FIG. 12. It is then pivoted forwardly toward the sole 12 and beneath the arch 18 and substantially parallel to the ground as shown in FIG. 3. During this pivotal movement, the high heel extension piece 24 is incapable of rotational movement about its own long axis. After the high heel extension piece 24 is pivoted forwardly into proper position, it is then moved axially rearwardly so that the beveled edge 32 fits into the opening 36 as shown most clearly in FIGS. 4 and 13. The purpose of being able to pull downwardly the high heel extension piece 24 is so that it may clear the low heel lift 28 and the forward edge of the low heel block 22 as it is pivoted towards the low heel position. The same in reverse is true when repositioning the invention from the low to high heel position.

The mechanism which allows for the limited axial and pivotal movement of the high heel extension piece 24 will now be described. A sturdy support beam 38, made of metal in the preferred embodiment, is molded or otherwise secured to the high heel extension piece 24 and protrudes or extends upwardly from the top of the high heel extension piece 24. The support beam 38 is preferably of rectangular cross-section as is, perhaps, best shown in FIG. 3. While rectangular is the preferred cross sectional profile of the support beam, it need not be precisely rectangular. The front and back edges could, for example, be pointed or rounded. What is required, however, is that the principal left and right surfaces of the cross sectional profile are flat and parallel to each other.

The support beam 38 may have one or more notches formed therein such as shown at 40 (FIGS. 11 and 12) so that it is securely held in the high heel extension piece 24. This can be accomplished by molding the high heel extension piece 24 around the support beam 38. The support beam 38 essentially defines a substantially central axis of the high heel extension piece 24.

The low heel block 22 is provided with a slot 42. The slot 42 extends from the bottom of the low heel lift 28 as shown in FIG. 5 so as to be accessible from the bottom of the low heel block 22 and is also present at the front of the low heel block 22 facing forwardly under the arch portion 18. As shown most clearly in FIGS. 2, 3 and 5, the slot 42 begins at approximately the mid-point of the low heel lift 28 and extends forwardly and upwardly to approximately the mid-point of the opening 36 at the front of the low heel block 22.

The slot 42 extends into the interior of the low heel block 22 as shown in FIGS. 11-17. The width of the slot 42 is just very minimally wider than but in close tolerance with the thickness or width of the support beam 38. This allows the support beam 38 to move axially within the slot and to pivot within the slot as described above. However, the shape of the slot 42 relative to the shape of the support beam 38 helps to prevent rotational movement of the support beam 38 and, therefore, of the high heel extension piece 24 about its own axis.

Figure 8:
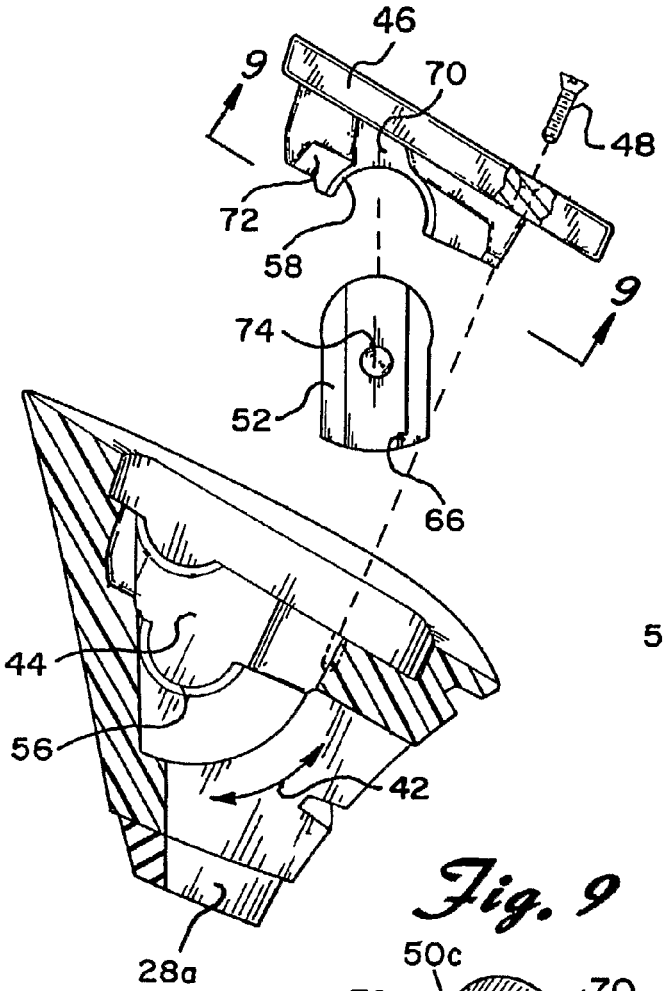
FIG. 8 is an exploded view, shown partially in cross-section, of the low heel block and its related components.
Figure 9:
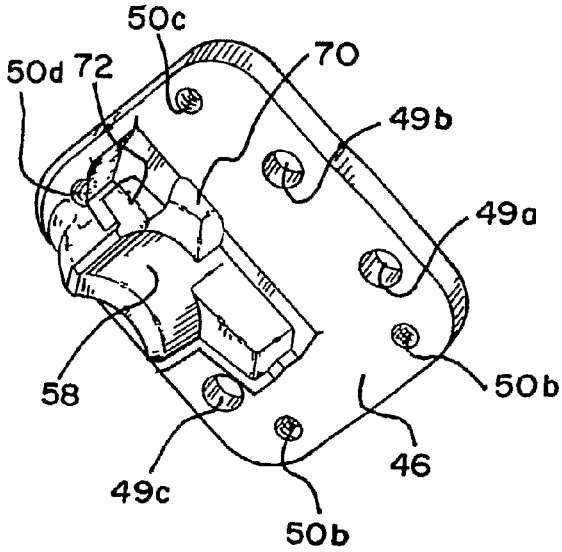
FIG. 9 is bottom perspective of the upper force plate of the heel taken along the line 9-9 of FIG. 8.

The low heel block 22, which is preferably made of a strong lightweight molded material, includes a cavity 44 therein which houses the mechanism that allows for axial and pivotal movement of the high heel extension piece 24. The cavity 44 is open at the top as shown in FIG. 8. A sturdy force plate 46, made of metal in the preferred embodiment, closes the opening at the top of the cavity 44 and is secured to the remaining portions of the low heel block 22 through the use of a plurality of screws 48 or any other substantial means known to those skilled in the art such as shown in FIG. 8 that pass through openings 49*a*, 49*b* and 49*c* in the force plate shown in FIG. 9. As shown in FIG. 2, three such screws 48 are utilized in the preferred embodiment.

The force plate 46 also includes a plurality of threaded openings 50*a*, 50*b*, 50*c* and 50*d* in the top surface thereof. Bolts such as shown at 51*a*, 51*b* etc. pass through the sole 12 at the heel portion 16 thereof and are threaded into the threaded openings. This secures the heel 10 to the remaining parts of the shoe.

Figure 10:
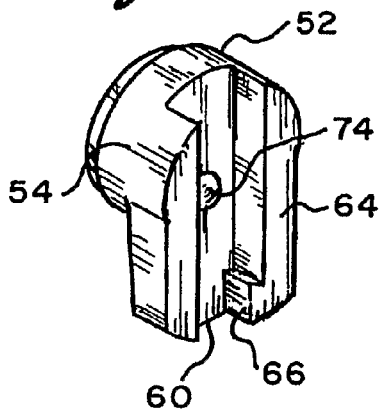
FIG. 10 is a perspective view of a rotary member forming part of the invention and referred to herein as the rotatable slotted pivot.

The cavity 44 within the low heel block 22 and the force plate 46, when secured to the low heel block 22, defines an enclosure which is complementary to and contains a rotatable slotted pivot 52 which is, perhaps, best shown in FIG. 10. The rotatable slotted pivot 52 includes an upper cylindrical portion 54 which is positioned within the cavity so as to contact the semi-circular lower support 56 formed in the chamber 44 and also the upper semi-circular portion 58 formed at the bottom of the force plate 46. That is, when the force plate 46 is secured in its proper position, a circular bearing is formed between semi-circular portions 56 and 58 and the cylindrical portion 54 of the slotted pivot 52 is positioned therein.

The front face 64 of the slotted pivot 52 includes an elongated groove 60 into which is slid the upper end 62 of the support beam 38. The support beam 38 freely slides axially up and down in the groove 60 as shown in FIGS. 11 and 12. When slotted pivot 52 is secured within cavity 44 of low heel block 22 by force plate 46, a flat inner wall of cavity 44 abuts front face 64 of slotted pivot 52 providing a fourth side to seal off elongated groove 60 and create a channel. Support beam 38 slides in and out of this channel as described below. Elongated groove 60 and the resultant channel just described have a rectangular shaped cross section, complementary to the rectangular cross section of the upper end 62 of the support beam 38, so as to prevent rotational movement of the support beam 38 about its own axis. There is a tight tolerance of fit between the elongated groove 60/resultant channel and the upper end 62 of the support beam 38 so that there is no wiggle room for rotational or translational movements. There is furthermore a very tight tolerance of fit in the lower end of the elongated groove 60 and the width of the main portion of the support beam 38 at the level of the inward projection 66 of the elongated groove 60 described below. These features create a very stable and secure heel for the wearer.

Although the support beam 38 can freely slide within the groove 60, means are provided for preventing removal of the support beam from the groove. Side wall 64 of the slotted pivot 52 that forms the groove 60 has an inward projection 66 at the bottom thereof. A complementary projection 68 is formed on the support beam 38 adjacent the upper end thereof. As shown most clearly in FIGS. 11 and 12, as the support beam 38 moves downwardly the upper end 62 passes through the groove 60 in the slotted pivot 52, further downward motion is prevented when the projection 68 engages the projection 66 (specifically seen in FIG. 12). This prevents accidental removal of the support beam 38 and the high heel extension piece 24 from the low heel block 22.

The inner surface of the force plate 46 has two recesses formed therein which are shaped so as to be essentially complementary to the upper end 62 of the support beam 38. The first recess 70 is aligned essentially along a vertical axis when the parts are assembled. As a result, when the heel 20 is in the first or high heel position, the upper end 62 of the support beam 38 enters the recess 70 and abuts against the force plate 46. (See FIGS. 11 and 12.) As a result, the force plate 46 essentially takes up almost all of the vertical forces that are applied by support beam 38. In this manner, the support beam 38 and force plate 46 bear virtually all of the weight of the wearer that passes from the high heel extension piece 24 to the heel portion of the sole 16. In this manner, the beveled edge 32 of the high heel extension piece 24 is protected from impaction damage as it abuts high heel extension piece 24 when the wearer is walking in the high heel position.

Figure 13:
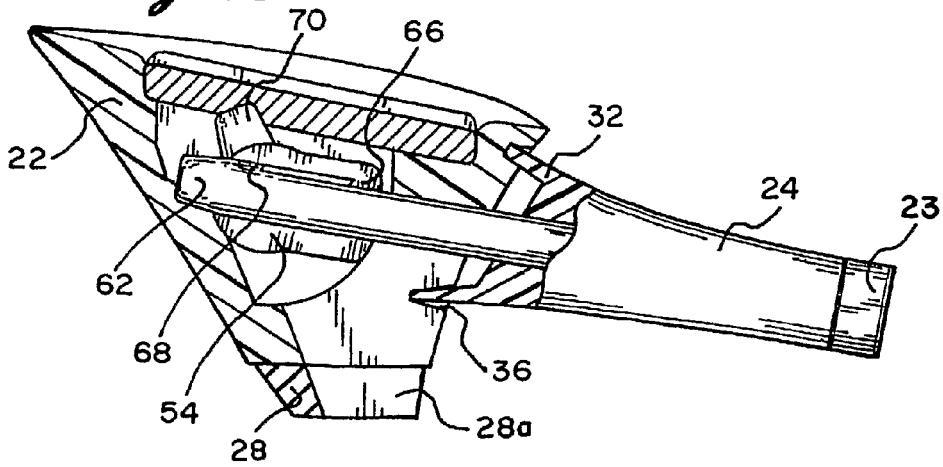
FIG. 13 is a cross-sectional view similar to FIGS. 11 and 12 but showing the heel in its stowed low heel configuration.

The second recess 72 is at a substantial angle to the first recess 70 and lies toward the rear end of the force plate 46. The confines of recess 72 are defined in part by features at the undersurface of force plate 46 and in part by adjacent features in cavity 44 of low heel block 22. When the high heel extension piece 24 is in its second or low heel position as shown in FIGS. 4 and 13, the upper end 62 of the support beam 38 lies within the recess 72. As should be readily apparent, this is accomplished by pulling the high heel extension piece 24 downwardly so as to release the top 62 of the support beam 38 from the recess 70 which allows the same to then be pivoted. The high heel extension piece 24 and support beam 38 and slotted pivot 52 are then pivoted as shown in FIG. 3. The pivoting is continued until they are in proper alignment in the second or low heeled position and are then moved inwardly so that the end 62 of the support beam 38 enters the recess 72 as seen in FIGS. 4 and 13.

It should be noted that whenever the upper end 62 of the support beam 38 is protruding through the top of the channel created by slotted pivot 52 and it extends in either recess 72 or recess 70, the mechanism is securely locked from pivoting. This is an important safety feature. The high heel extension piece 24 can not be pivoted to the opposite position, high or low heel, with out first unlocking the slotted pivot 52 by pulling the high heel extension piece 24 to draw the support beam 38 out of the given recess. It should also be noted that cavity 44 of low heel block 22 defines the range of rotation of slotted pivot 52 as is seen in FIGS. 11 and 13. This further adds to the stability of the mechanism.

Figure 14:
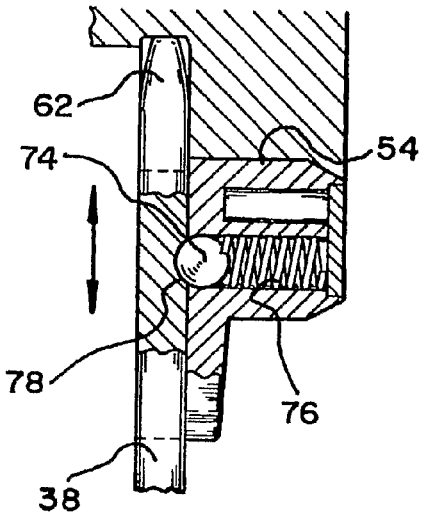
FIG. 14 is a cross-sectional view taken through the line 14-14 of FIG. 11 showing the spring biased ball detent mechanism contained within the rotatable slotted pivot.
Figure 15:
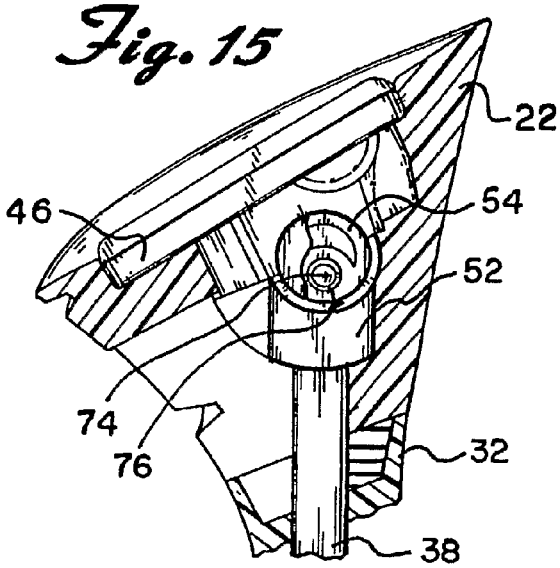
FIG. 15 is a cross-sectional view taken through the line 15-15 of FIG. 2.
Figure 16:
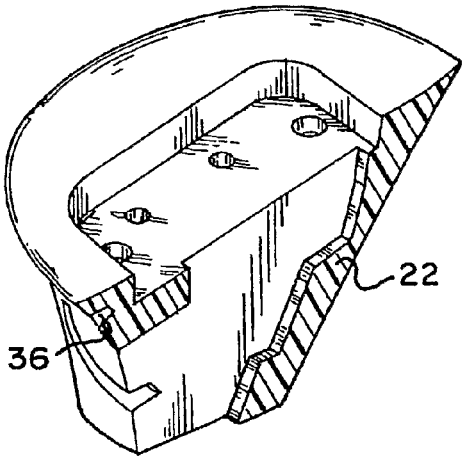
FIG. 16 is a cross-sectional view of the left half of the low heel block without the operating mechanism.
Figure 17:
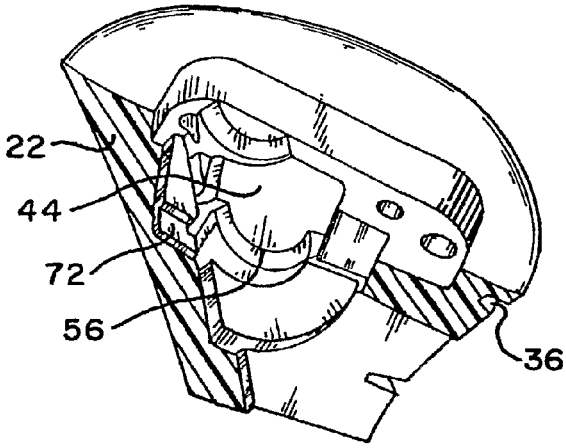
FIG. 17 is a cross-sectional view of the right half of the low heel block without the operating mechanism.

The slotted pivot 52 and support beam 38 are also provided with a detent mechanism incorporated into rotatable slotted pivot 52 for maintaining the high heel extension piece 24 in its proper and desired high or low heel position. This is accomplished by a ball 74 that protrudes into groove 60 and is spring biased into groove 60 by the use of a spring 76 as seen in FIG. 14. The side of support beam 38 facing the spring-biased ball 74 includes a depression 78 therein. When the ball 74 enters the depression 78, free movement of the support beam 38 is prevented. The depression 78 is located in a position on the support beam 38 which coincides with the upper end of the support beam fully entering either recess 70 or 72 in the force plate 46.

Thus, when the high heel extension piece 24 is in either of the first or second positions, the spring-loaded ball 74 enters the depression 78 and retains the same in position. The force of the ball 74 in the depression 78 can, however, be manually overcome by a person simply pulling downwardly or outwardly on the high heel extension piece 24 to release the detent or stop means.

The present invention may be embodied in other specific forms without departing from the spirit or essential attributes thereof and accordingly, reference should be made to the appended claims rather than to the foregoing specification as indicating the scope of the invention.

The invention claimed is:

1. In a shoe having a sole with a toe portion, a heel portion and an arch portion located between said heel and toe portions, the improvement comprised of a stowable heel comprising:

a low heel block attached to the heel portion of said shoe sole, said low heel block having a slot formed therein that is open adjacent the bottom of said low heel block and continues through the forward part of said low heel block adjacent said arch portion of said shoe;

a high heel extension piece attached to said low heel block, said high heel extension piece having a support beam affixed therein and protruding upwardly from the top of said high heel extension piece, said support beam having a substantially rectangular cross-section and defining a substantially central axis of said high heel extension piece, said support beam being capable of limited axial and pivotal movement within said slot, said support beam further including a depression in a side thereof;

said low heel block including a spring biased ball located adjacent said slot with said ball engaging said support beam whereby, when said support beam is moved axially, said spring biased ball is adapted to fit within said depression, the location of said depression and of said ball being such that when said ball enters said depression, said high heel extension piece is in a the first or second position;

the dimensions of said support beam and said slot preventing rotational movement of said high heel extension piece about the central axis of said high heel extension piece relative to said low heel block, and a rotatable slotted pivot including an elongated groove for allowing pivotal motion of said high heel extension piece relative to said sole so that said high heel extension piece can be moved between a first position wherein said high heel extension piece underlies and is in substantial alignment with said low heel block creating a high heel and a second position wherein said high heel extension piece lies substantially beneath said arch portion of said sole resulting in a low heel, said spring biased ball being carried by said pivot and enters said groove.

2. The invention according to claim 1 wherein the bottom of said low heel block has a low heel lift of noncircular cross-section that extends downwardly, and is the portion of the heel that engages the ground when the high heel extension piece is in the second position stowed under the arch of the sole.

3. The invention according to claim 2 wherein said low heel lift is essentially U-shaped.

4. The invention according to claim 2 wherein said low heel lift is removably attached to the remaining portion of said low heel block for the purpose of replacement when worn out.

5. The invention according to claim 4 wherein said low heel lift includes a plurality of stems extending upwardly and wherein said low heel block includes a plurality of apertures therein for receiving said stems for the purpose of securing the low heel lift to the low heel block.

6. The invention according to claim 5 wherein each of said stems, the inner walls of their apertures, or both have a textured surface providing a friction fit between said stem and said apertures in order to maintain said low heel lift in place.

7. The invention according to claim 2 wherein said high heel extension piece has a recess in the top thereof surrounded by a beveled edge that fits over the low heel lift of said low heel block and hides the low heel lift when the heel is in the high heel configuration.

8. The invention according to claim 7 wherein said low heel block includes an opening at a forward surface facing towards the toe region adjacent the arch portion of said shoe, said opening being essentially the same shape as the perimeter of the beveled edge and top of the high heel extension piece with a substantial portion of the beveled edge of said high heel extension piece fitting into said opening when said high heel extension piece is in the second position.

9. The invention according to claim 2 wherein the bottom of said high heel extension piece has a high heel lift that extends downwardly and is the portion of the high heel that engages the ground when the high heel extension piece is in the high heel position.

10. The invention according to claim 9 wherein said high heel lift is removably attached to the remaining portion of said high heel extension piece for the purpose of replacement when worn out.

11. The invention according to claim 10 wherein said high heel lift includes a stem extending upwardly and wherein said high heel extension piece includes an aperture therein for receiving said stem.

12. The invention according to claim 11 wherein said stem, the inner walls of said aperture, or both have a textured surface providing a friction fit between said stem and said aperture in order to maintain said high heel lift in place.

13. The invention according to claim 1 wherein said spring biased ball prevents unwanted axial movement of said support beam when said ball is in said depression.

14. In a shoe having a sole with a toe portion, a heel portion and an arch portion located between said heel and toe portions, the improvement comprised of a stowable heel comprising:

a low heel block attached to the heel portion of said shoe sole, said low heel block having a slot formed therein that is open adjacent the bottom of said low heel block and continues through the forward part of said low heel block adjacent said arch portion of said shoe;

a high heel extension piece attached to said low heel block, said high heel extension piece having a support beam affixed therein and protruding upwardly from the top of said high heel extension piece, said support beam having a substantially rectangular cross-section and defining a substantially central axis of said high heel extension piece, said support beam being capable of limited axial and pivotal movement within said slot;

the dimensions of said support beam and said slot preventing rotational movement of said high heel extension piece about the central axis of said high heel extension piece relative to said low heel block, and a cavity within said low heel block and a rotatable slotted pivot located within said cavity for allowing pivotal motion of said high heel extension piece relative to said sole so that said high heel extension piece can be moved between a first position wherein said high heel extension piece underlies and is in substantial alignment with said low heel block creating a high heel and a second position wherein said high heel extension piece lies substantially beneath said arch portion of said sole resulting in a low heel.

15. The invention according to claim 14 wherein said cavity includes a flat wall and wherein said slotted pivot includes an elongated groove, said wall and said groove defining an opening for allowing limited axial movement of said support beam but preventing rotational movement thereof about said axis.

16. The invention according to claim 15 further including stop means for preventing said support beam from being removed from said opening formed between said groove and said wall.

17. In a shoe having a sole with a toe portion, a heel portion and an arch portion located between said heel and toe portions, the improvement comprised of a stowable heel comprising:

a low heel block attached to the heel portion of said shoe sole, said low heel block having a slot formed therein that is open adjacent the bottom of said low heel block and continues through the forward part of said low heel block adjacent said arch portion of said shoe;

a high heel extension piece attached to said low heel block, said high heel extension piece having a support beam affixed therein and protruding upwardly from the top of said high heel extension piece, said support beam having a substantially rectangular cross-section and defining a substantially central axis of said high heel extension piece, said support beam being capable of limited axial and pivotal movement within said slot;

the dimensions of said support beam and said slot preventing rotational movement of said high heel extension piece about the central axis of said high heel extension piece relative to said low heel block;

means for allowing pivotal motion of said high heel extension piece relative to said sole so that said high heel extension piece can be moved between a first position wherein said high heel extension piece underlies and is in substantial alignment with said low heel block creating a high heel and a second position wherein said high heel extension piece lies substantially beneath said arch portion of said sole resulting in a low heel, and a sturdy force plate secured to the top of said low heel block, said support beam including an upper free end that is adapted to engage the lower surface of said sturdy force plate in either of the two positions and is prevented from further rotation by engagement with said force plate.

18. The invention according to claim 17 wherein said force plate through said support beam bears the weight of the wearer when said high heel extension piece underlies and is in substantial alignment with said low heel block creating a high heel.

19. The invention according to claim 17 further including means for securing said force plate to the sole of the shoe.

20. The invention according to claim 19 wherein said means for securing includes a plurality of threaded bolts and a plurality of threaded apertures formed in said force plate.

* * * * *